US010426021B2

(12) United States Patent
Caspari et al.

(10) Patent No.: US 10,426,021 B2
(45) Date of Patent: Sep. 24, 2019

(54) MICROELECTRONIC MODULE FOR ALTERING THE ELECTROMAGNETIC SIGNATURE OF A SURFACE, MODULE ARRAY AND METHOD FOR ALTERING THE ELECTROMAGNETIC SIGNATURE OF A SURFACE

(71) Applicant: AIRBUS DEFENCE AND SPACE GMBH, Taufkirchen (DE)

(72) Inventors: Ralf Caspari, Kösching (DE); Robert Weichwald, Siegenburg (DE); Emanuel Ermann, Oberstimm/Manching (DE); Christian Karch, Neubiberg (DE)

(73) Assignee: Airbus Defence and Space GmbH, Taufkirchen (DE)

( * ) Notice: Subject to any disclaimer, the term of this patent is extended or adjusted under 35 U.S.C. 154(b) by 157 days.

(21) Appl. No.: 15/656,333

(22) Filed: Jul. 21, 2017

(65) Prior Publication Data

US 2018/0035527 A1 Feb. 1, 2018

(30) Foreign Application Priority Data

Jul. 26, 2016 (DE) ..... 10 2016 008 945

(51) Int. Cl.
*H01Q 1/42* (2006.01)
*H05H 1/24* (2006.01)
*H05H 1/46* (2006.01)

(52) U.S. Cl.
CPC ..... *H05H 1/46* (2013.01); *H01Q 1/425* (2013.01); *H05H 1/2406* (2013.01); *H05H 2001/2418* (2013.01); *H05H 2001/2425* (2013.01)

(58) Field of Classification Search
CPC ..... H01Q 1/42; H01Q 1/425; H05H 1/2406; H05H 1/46; H05H 2001/2418; H05H 2001/2425
See application file for complete search history.

(56) References Cited

U.S. PATENT DOCUMENTS 4,516,747 A 5/1985 Lurz
4,732,351 A 3/1988 Bird
(Continued)

FOREIGN PATENT DOCUMENTS

CN 1596060 A 3/2005
DE 199 31 366 A1 2/2001
(Continued)

OTHER PUBLICATIONS

Extended European Search Report for Application No. 17001095.3 dated Dec. 14, 2017.
(Continued)

*Primary Examiner* — Tho G Phan
(74) *Attorney, Agent, or Firm* — Jenkins, Wilson, Taylor & Hunt, P.A.

(57) ABSTRACT

A microelectronic module for altering the electromagnetic signature of a surface. The microelectronic module includes at least one voltage converter for converting a first voltage provided into a higher, lower or identical second voltage. Furthermore, the microelectronic module includes at least one actuator. The actuator includes at least one generator for generating an electrical plasma from the second voltage provided by the voltage converter. At least the voltage converter and the actuator are arranged on a thin-layered planar substrate. The electrical plasma generated by the actuator interacts with an electromagnetic radiation impinging on the surface, as a result of which the electromagnetic signature is altered.

14 Claims, 4 Drawing Sheets

(56) References Cited

U.S. PATENT DOCUMENTS

| | | | | |
|---|---|---|---|---|
| 4,891,118 | A * | 1/1990 | Ooiwa | C23C 16/515 118/723 MR |
| 5,172,024 | A | 12/1992 | Broussoux et al. | |
| 5,535,906 | A * | 7/1996 | Drummond | H01J 37/32009 216/67 |
| 5,542,200 | A | 8/1996 | Matsuoka | |
| 5,844,369 | A * | 12/1998 | Yoshizako | H05H 1/46 315/111.21 |
| 6,774,885 | B1 | 8/2004 | Even-Zohar | |
| 7,008,596 | B1 | 3/2006 | Rump et al. | |
| 7,142,075 | B1 * | 11/2006 | Roesler | H02K 35/02 335/78 |
| 7,255,062 | B1 | 8/2007 | Higman | |
| 7,378,801 | B2 | 5/2008 | Jeon | |
| 7,624,941 | B1 | 12/2009 | Patel et al. | |
| 7,703,479 | B2 | 4/2010 | Jacob | |
| 7,811,941 | B1 * | 10/2010 | Becker | H01J 37/321 216/67 |
| 8,091,836 | B2 | 1/2012 | Minick | |
| 8,159,407 | B2 | 4/2012 | Dittrich et al. | |
| 8,181,910 | B2 | 5/2012 | Lewis | |
| 8,267,355 | B1 | 9/2012 | Patel et al. | |
| 9,067,674 | B2 | 6/2015 | Nordin et al. | |
| 2004/0223316 | A1 | 11/2004 | Bachmann et al. | |
| 2006/0145630 | A1 | 7/2006 | Jeon | |
| 2007/0216735 | A1 | 9/2007 | Kobayashi et al. | |
| 2009/0120471 | A1 | 5/2009 | Ludwiczak | |
| 2010/0108821 | A1 | 5/2010 | Lewis | |
| 2010/0228144 | A1 | 9/2010 | Labat | |
| 2012/0065549 | A1 | 3/2012 | Shelhamer | |
| 2012/0193483 | A1 | 8/2012 | Essenhigh et al. | |
| 2014/0366552 | A1 | 12/2014 | Szwedowicz et al. | |
| 2015/0047732 | A1 | 2/2015 | Bassler et al. | |
| 2016/0280379 | A1 | 9/2016 | Giles et al. | |
| 2017/0043863 | A1 | 2/2017 | Caspari et al. | |
| 2017/0144199 | A1 | 5/2017 | Caspari | |

FOREIGN PATENT DOCUMENTS

| | | | |
|---|---|---|---|
| DE | 101 29 041 | A1 | 12/2002 |
| DE | 10261875 | A1 | 7/2004 |
| DE | 103 20 467 | B4 | 2/2006 |
| DE | 10 2004 060 675 | A1 | 6/2006 |
| DE | 102007051243 | B3 | 4/2009 |
| DE | 102012001981 | A1 | 8/2013 |
| DE | 10 2014 110 405 | | 1/2016 |
| EP | 0363521 | A1 | 4/1990 |
| EP | 2623020 | A1 | 8/2013 |
| EP | 2662284 | A2 | 11/2013 |
| EP | 2560867 | B1 | 3/2016 |
| EP | 3 133 014 | B1 | 11/2018 |
| EP | 3 165 468 | B1 | 3/2019 |
| FR | 2667256 | A1 | 4/1992 |
| WO | WO 2009/124913 | A2 | 10/2009 |
| WO | WO 2015/024601 | A1 | 2/2015 |

OTHER PUBLICATIONS

German Office Action for Application No. 10 2016 008 945 dated Apr. 11, 2017.

Chinese Office Action for Application No. 2017106178980 dated Nov. 2, 2018.

Final Office Action for U.S. Appl. No. 15/233,495 dated Nov. 27, 2018.

European Search Report for Application No. 16002328 dated Jan. 26, 2017.

German Search Report for Application No. 16001567 dated Jan. 19, 2017.

Non-Final Office Action for U.S. Appl. No. 15/233,495 dated Sep. 14, 2017.

Final Office Action for U.S. Appl. No. 15/233,495 dated Feb. 9, 2018.

Non-Final Office Action for U.S. Appl. No. 15/233,495 dated Jun. 25, 2018.

Restriction Requirement for U.S. Appl. No. 15/343,886 dated Jun. 28, 2018.

Anderson, et al., "Plasma Frequency Selective Surfaces," In: IEEE Transactions on Plasma Science, vol. 35, No. 2, pp. 407-415 dated Apr. 2007.

Kim, "Numerical Investigation of 3-D Radar Cross Section of Dielectric Barrier Discharge Plasma," In: Asia-Pacific Microwave Conference APMC dated Dec. 2015.

Lee, "Scattering Characteristics of Atmospheric Pressure Dielectric Barrier Discharge Plasma," In: Proceedings of the 10th European Radar Conference, pp. 555-558 dated Oct. 2013.

Yuan, et al., "Properties of Propagation of Electromagnetic Wave in a Multilayer Radar-Absorbing Structure With Plasma- and Radar-Absorbing Material," In: IEEE Transactions on Plasma Science, vol. 39, No. 9, pp. 1768-1775 dated Sep. 2011.

Clarke, et al., "Unilateral examination of utricle and saccule function," Journal of Vestibular Research, vol. 13, Issue 4-6, pp. 215-225 dated Dec. 30, 2003.

International Search Report with Written Opinion for Application No. PCT/DE2016/000026 dated Jun. 7, 2016.

Lopez, et al., "Changes of visual vertical perception: A long-term sign of unilateral and bilateral vestibular loss," Neuropsychologia, Pergamon Press, Oxford, GB, vol. 45, No. 9, pp. 2025-2037, XP022052754, ISSN: 0028-3932, DOI: 10.1016/j. neuropsychologia. 2007.02.004 dated Apr. 29, 2007.

Non-Final Office Action for U.S. Appl. No. 15/343,886 dated Nov. 30, 2018

German Office Action for Application No. 10 2015 014 256.9 dated Apr. 5, 2019.

Final Office Action for U.S. Appl. No. 15/343,886 dated Feb. 25, 2019.

Interview Summary for U.S. Appl. No. 15/343,886 dated Mar. 15, 2019.

Final Office Action for U.S. Appl. No. 15/233,495 dated Apr. 2, 2019.

* cited by examiner

MICROELECTRONIC MODULE FOR ALTERING THE ELECTROMAGNETIC SIGNATURE OF A SURFACE, MODULE ARRAY AND METHOD FOR ALTERING THE ELECTROMAGNETIC SIGNATURE OF A SURFACE

CROSS-REFERENCE TO RELATED APPLICATION

This application claims priority to German patent application DE 10 2016 008 945.8 filed Jul. 26, 2016, the entire disclosure of which is incorporated by reference herein.

TECHNICAL FIELD

Various embodiments generally relate to a microelectronic module for altering the electromagnetic signature of a surface, and a module array and a method for altering the electromagnetic signature of a surface.

BACKGROUND

The development of modern vehicles, for example modern aircraft, is tending more and more toward reducing discoverability by enemy radar, for example. By way of example, this is achieved by so-called stealth technology. In this case, inter alia, the geometric shape of a vehicle, such as, for example, a ship, a land vehicle or an aircraft, is optimized to the effect that the vehicle for example on an enemy radar screen appears significantly smaller or is represented at a different position or in a delayed manner. However, such geometric optimizations have the disadvantage, for example, that often they only act passively and are not adaptable to the respective situation.

Taking this as a departure point, it is an object of the disclosure herein to specify a device which avoids the disadvantages mentioned above.

This object is achieved by a device having the features herein and by a method having the features herein. Exemplary embodiments are presented in the dependent claims. It should be pointed out that the features of the exemplary embodiments of the devices also apply to embodiments of the method, and vice versa.

SUMMARY

A microelectronic module for altering the electromagnetic signature of a surface is specified. The microelectronic module comprises at least one voltage converter for converting a first voltage provided into a higher, lower or identical second voltage. Furthermore, the microelectronic module comprises at least one actuator. The actuator comprises at least one generator for generating an electrical plasma from the second voltage provided by the voltage converter. At least the voltage converter and the actuator are arranged on a thin-layered planar substrate. The electrical plasma generated by the actuator interacts with an electromagnetic radiation impinging on the surface, as a result of which the electromagnetic signature is altered.

The disclosure herein is based on the concept of altering the electromagnetic signature of a surface by generating an electrical plasma that interacts with an electromagnetic radiation impinging on the surface. In this case, the electrical plasma can be generated depending on the electromagnetic radiation impinging on the surface and the electromagnetic signature of a surface can thereby be altered. The electromagnetic signature emitted by the surface, as a result of the interaction with the electrical plasma, is preferably altered relative to an electromagnetic signature reflected back without being influenced, i.e. for example the radar cross section of a vehicle appears altered, preferably reduced, on a radar screen, for example, as a result. Consequently, by way of example, the electromagnetic signature can adapt actively to the respective situation.

The designation "actuator" can be understood as any type of device which is suitable for converting an electrical signal into some other physical variable.

The designation "voltage converter" can be understood as any electrical element which is able to convert an input voltage into a higher, lower or identical output voltage. For the case where the input voltage corresponds to the output voltage, the electrical element can also consist just of an electrical connection element.

In accordance with one preferred embodiment, the microelectronic module furthermore comprises at least one detection unit. The detection unit comprises at least one sensor for detecting an electromagnetic radiation impinging on the surface. The sensor can be suitable, for example, for detecting electromagnetic interactions of photons impinging on the sensor with the electrons or atomic nuclei of a detector material of the sensor.

In accordance with one preferred embodiment, the microelectronic module furthermore comprises a control unit. The control unit is configured for controlling the generation of the electrical plasma depending on a signal from the detection unit, a receiver, control commands of a superordinate transmitting and/or control element, and/or information from at least one further conventional sensor, an antenna and/or a control or regulating system. The receiver is configured for receiving external data, containing information about the detection of the electromagnetic radiation impinging on the surface. The microelectronic module can thus be controlled in a targeted manner in accordance with the detected electromagnetic radiation in order to alter the electromagnetic signature of a surface.

In accordance with one preferred embodiment, the actuator is furthermore configured to detect the electromagnetic radiation impinging on the surface. As an alternative to external sensors, the actuator itself can also be able to detect the electromagnetic radiation impinging on the surface. This has the advantage that no further detectors or sensors are required, or the detection can be improved by combination with further detectors or sensors.

In accordance with one preferred embodiment, the electrical plasma is generated depending on the detected electromagnetic radiation and/or the received data about the electromagnetic radiation impinging on the surface. In a manner dependent on the detected electromagnetic radiation and/or the received data about the electromagnetic radiation impinging on the surface, the electrical plasma is generated. This has the advantage that the generation of the electrical plasma can be adapted to the requirements.

In accordance with one preferred embodiment, the electromagnetic signature of the surface is altered by absorbing and/or reflecting an outer wave of the electromagnetic radiation. By reducing the backscattering of the electromagnetic radiation and/or by damping the surface wave of the electromagnetic radiation, it is possible to alter for example the absorption and/or reflection of the electromagnetic radiation. Alternatively, the electromagnetic signature of the surface can also be altered for example by a combination of the above-described absorption and/or reflection with, for example, a conventional RAM (radar-absorbing material)

coating or other radar-absorbing materials or else an infrared camouflage. This has the advantage that, for example, the radar-absorbing properties of a RAM coating can be improved.

In accordance with one preferred embodiment, a frequency-selective surface is generated with the aid of the at least one actuator. By the driving of the at least one actuator, distributed or periodically conductive plasma structures are generatable preferably on, in or below the surface. The generated plasma preferably has a specific frequency band. The width of the frequency band and/or the center frequency are/is preferably controllable by an applied magnetic field. Preferably, an active metamaterial is formed by the influencing of the generated plasma. The active metamaterial is usable for example as band-pass filter, band-stop filter, high-pass filter, low-pass filter or a combination thereof, for altering the electromagnetic waves. This has the advantage that the electromagnetic radiation can be altered in a targeted manner in order thereby to falsify the radar image, for example.

In accordance with one preferred embodiment, the thin-layered planar substrate is a flexible and/or multidimensionally deformable film or lattice. By way of example, the lattice can have a flexible and/or multidimensionally deformable lattice structure. The thin-layered planar substrate can alternatively also consist of a comparable material which is suited to enabling the components of the module to be applied, introduced or fitted thereon and which is as thin as possible and stable enough. By way of example, the substrate can also comprise a fabric, a lattice structure or a composite material. This has the advantage that the module can be kept small in terms of its geometric dimensions, a sufficient stability being provided to apply, for example to adhesively bond, the module permanently or reversibly on a surface, for example.

In accordance with one preferred embodiment, the module comprises a plurality of actuators. The plurality of actuators preferably have a different and/or identical orientation. This has the advantage that the electromagnetic radiation impinging on the module from different directions, for example, can be altered in a targeted manner.

In accordance with one preferred embodiment, the module comprises at least one switching element for activating and/or deactivating the module and/or at least one of the plurality of actuators. This has the advantage that the one individual module itself, or one module or two or more modules from a plurality of modules can be activated and/or deactivated in a targeted manner.

The designation "switching element" can be understood as any type of device which is suitable for altering a connection from an interrupted state to a connected state. This can also be understood to mean a connection which is open at one end and which can be closed permanently or reversibly for example by connecting the module to, for example, an electronic unit for control.

In accordance with one preferred embodiment, an antenna that is freely definable on the surface or an antenna array for adapting antenna gain, polarization and receiving direction can be formed by the actuators.

In accordance with one preferred embodiment, the antenna or the antenna array is usable as transmitting and/or receiving antenna for electromagnetic radiation. This has the advantage that the antenna or the antenna array, if necessary, can be used for sending and/or receiving data. This has the advantage that the module is also usable as receiving and/or transmitting antenna.

In accordance with one preferred embodiment, the transmitting and/or receiving antenna can be coupled to an external transmitter and/or receiver via a coupling-in and/or coupling-out device. This has the advantage that the antenna or the antenna array, which can be embodied as transmitting and/or receiving antenna, for example, is connectable to an external transmitter and/or receiver. As a result, for example, data can be sent by the external transmitter via the antenna, embodied as transmitting antenna, or the antenna array and/or data can be received by the external receiver via the antenna, embodied as receiving antenna, or the antenna array.

In accordance with one preferred embodiment, the voltage converter, the switching element, the actuator, the detection unit, the sensor, the receiver, the transmitter and/or the control element are/is embodied as MEMS (MicroElectro-Mechanical System) structure. Alternatively, the voltage converter, the switching element, the actuator, the detection unit, the sensor, the receiver, the transmitter and/or the control element can also be embodied as a nanoelectromechanical system. Further advantageous components of the module, insofar as is advantageous and applicable, can also be embodied for example as MEMS structure or as a nanoelectromechanical system. This has the advantage that the module and the components thereof can be kept very small in terms of dimensions. The space required for the module can thus be reduced to a minimum, for example.

Furthermore, a module array, comprising a plurality of microelectronic modules described above, is specified. By virtue of the arrangement of a plurality of the modules in an array, the alteration of the electromagnetic signature of a surface can be intensified and/or be used with targeted orientation.

In accordance with one preferred embodiment, it is also possible to arrange a plurality of microelectronic modules on a common thin-layered planar substrate. This has the advantage that, for example, the application of the module on a surface can be facilitated, or accelerated, as a result of which the costs for mounting can be reduced.

In accordance with one preferred embodiment, the actuators of the plurality of modules are drivable in a time-staggered and/or phase-shifted manner. The intensity can be influenced for example by utilization of interference phenomena. A time-staggered and/or phase-shifted driving of the actuators makes it possible to utilize interference phenomena in the generation of the electrical plasma in a targeted manner.

In accordance with one preferred embodiment, the module array comprises one or a plurality of switching elements configured to activate and/or to deactivate one or a plurality of actuators of the module array. This has the advantage that the module array can be controlled individually and the geometric dimensions can be kept small depending on the application.

Furthermore, an arrangement of at least one above-described microelectronic module or of at least one above-described module array on and/or in a surface of a vehicle is specified.

In accordance with one preferred embodiment, the surface has a coating that at least partly absorbs an electromagnetic radiation impinging on the surface. The coating can consist of a RAM material, for example.

In accordance with one preferred embodiment, the vehicle is an aircraft, a watercraft, or a land vehicle. By virtue of the arrangement of at least one module or of at least one module array, the electromagnetic signature can be altered, such that, for example, the electromagnetic signature can be reduced and the radar image of the vehicle can be falsified as a result.

Furthermore, a method for altering the electromagnetic signature of a surface using at least one above-described microelectronic module or at least one above-described module array is specified. The method comprises the step of converting a first voltage provided into a higher, lower or identical second voltage. Furthermore, the method comprises the step of detecting an electromagnetic radiation. The method furthermore comprises the step of generating an electrical plasma from the second voltage. Furthermore, the method comprises the step of altering the electromagnetic signature of the surface by interaction of the electrical plasma generated with an electromagnetic radiation impinging on the surface.

BRIEF DESCRIPTION OF THE DRAWINGS

In the example drawings, in general, identical reference signs refer to the same parts across the various views. The drawings are not necessarily true to scale; instead, importance is generally attached to elucidating the principles of the disclosure herein. In the following description, various embodiments of the disclosure herein are described with reference to the following drawings, in which.

DETAILED DESCRIPTION

Figure 1:
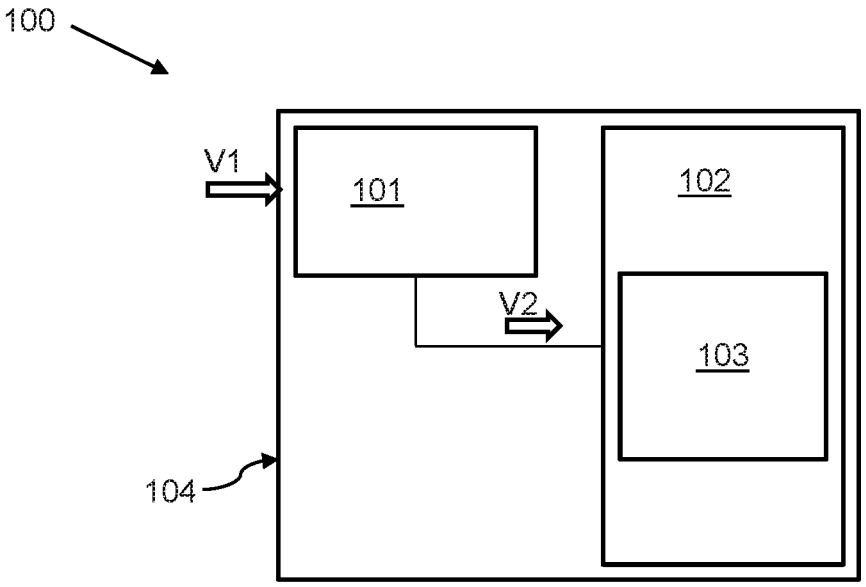
FIG. 1 shows a first embodiment of a microelectronic module.

The following detailed description refers to the accompanying drawings, which show for explanation purposes specific details and embodiments in which the disclosure herein can be practiced.

The word "exemplary" is used herein with the meaning "serving as an example, case or illustration". Any embodiment or configuration described herein as "exemplary" should not necessarily be interpreted as preferred or advantageous vis-à-vis other embodiments or configurations.

In the following detailed description, reference is made to the accompanying drawings, which form part of this description and show for illustration purposes specific embodiments in which the disclosure herein can be implemented. In this regard, direction terminology such as, for instance, "at the top", "at the bottom", "at the front", "at the back", "front", "rear", etc. is used with respect to the orientation of the figure(s) described. Since components of embodiments can be positioned in a number of different orientations, the direction terminology serves for illustration and is not restrictive in any way whatsoever. It goes without saying that other embodiments can be used and structural or logical changes can be made, without departing from the scope of protection of the present disclosure. It goes without saying that the features of the various exemplary embodiments described herein can be combined with one another, unless specifically indicated otherwise. Therefore, the following detailed description should not be interpreted in a restrictive sense, and the scope of protection of the present disclosure is defined by the appended claims.

In the context of this description, the terms "connecting", and "coupled" are used to describe both a direct and an indirect connection and a direct or indirect coupling. In the figures, identical or similar elements are provided with identical reference signs, insofar as this is expedient.

In the methods described here, the steps can be performed in virtually any arbitrary order, without departing from the principles of the disclosure herein, unless a temporal or functional sequence is expressly presented. If it is set out in a patent claim that firstly one step is performed and then a plurality of other steps are performed successively, then this should be understood to mean that the first step is carried out before all other steps, but the other steps can be carried out in any arbitrary suitable order, unless a sequence is set out within the other steps. Parts of claims in which for example "step A, step B, step C, step D and step E" are presented should be understood to mean that step A is performed first, step E is performed last and steps B, C and D can be performed in any arbitrary order between steps A and E, and that the sequence falls within the formulated scope of protection of the claimed method. Furthermore, specified steps can be performed simultaneously, unless express wording in the claim sets out that the steps are to be performed separately. By way of example, a step for performing X in the claim and a step for performing Y in the claim can be carried out simultaneously within a single procedure, and the resultant process falls within the worded scope of protection of the claimed method.

FIG. 1 shows a first embodiment of a microelectronic module 100. The microelectronic module 100 for altering the electromagnetic signature of a surface has a voltage converter 101 in the embodiment illustrated. The voltage converter 101 serves for converting a first voltage V1 provided into a higher, lower or identical second voltage V2. In the embodiment illustrated, the microelectronic module 100 furthermore comprises an actuator 102. In the embodiment illustrated, the actuator 102 comprises a generator 103 for generating an electrical plasma from the second voltage V2 provided by the voltage converter 101. The voltage converter 101 and the actuator 102 are arranged on a thin-layered planar substrate 104. The thin-layered planar substrate 104 is a film, for example. The electrical plasma generated by the actuator 102 interacts with an electromagnetic radiation impinging on the surface. In this case, the electromagnetic signature of the electromagnetic radiation impinging on the surface is altered, preferably reduced, by the electrical plasma. The voltage converter 101 is electrically coupled to the actuator 102.

In accordance with a further embodiment (not illustrated), the microelectronic module 100 can also comprise more than one voltage converter 101, wherein the plurality of voltage converters can also be electrically interconnected with one another and can for example interact as a result. The microelectronic module 100 can also comprise a plurality of actuators 102, wherein each actuator 102 can comprise for example one or a plurality of generators 103 for generating an electrical plasma. Furthermore, the microelectronic module 100 in accordance with one embodiment that is not illustrated can comprise a detection unit for detecting the electromagnetic radiation impinging on the surface, and/or a control unit, configured for controlling the generation of the electrical plasma depending on a signal from the detection unit, a receiver, configured for receiving external data, containing information about the detection of the electromagnetic radiation impinging on the surface, control commands of a superordinate transmitting and/or control element, and/or information from at least one further conventional sensor, an antenna and/or a control or regulating system.

The subject matter disclosed herein, such as the controller and/or other components herein, can be implemented with software in combination with hardware and/or firmware. For example, the subject matter described herein, such as the controller, can be implemented or used in association with software executed by a processor or processing unit. In one exemplary implementation, the subject matter described herein can be implemented using a computer readable medium having stored thereon computer executable instructions that when executed by a processor of a computer control the computer to perform steps. Exemplary computer readable mediums suitable for implementing the subject matter described herein include non-transitory devices, such as disk memory devices, chip memory devices, programmable logic devices, and application specific integrated circuits. In addition, a computer readable medium that implements the subject matter described herein can be located on a single device or computing platform or can be distributed across multiple devices or computing platforms.

Figure 2:
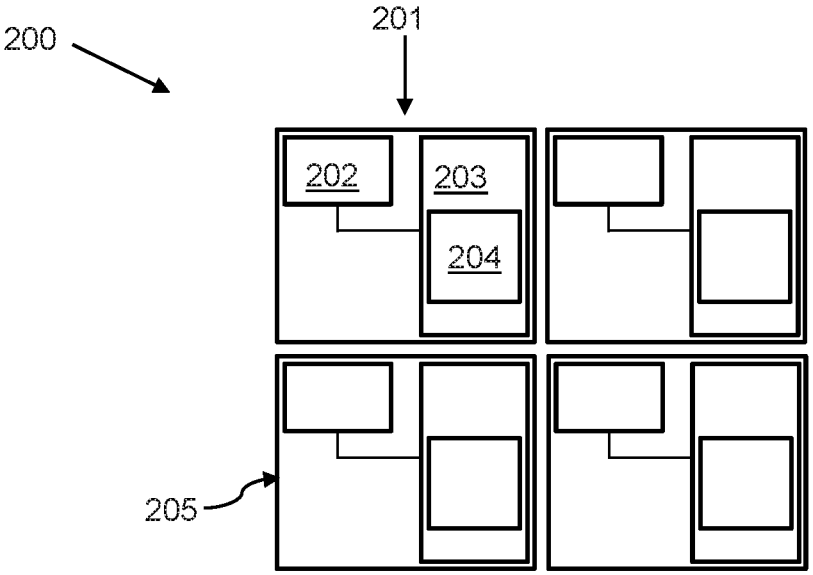
FIG. 2 shows a module array comprising a plurality of microelectronic modules.

FIG. 2 shows a module array 200 comprising a plurality of microelectronic modules 201. Each of the microelectronic modules 201 comprises a voltage converter 202 and an actuator 203, comprising a generator 204 on a thin-layered planar substrate 205. Although each of the modules 201 illustrated can comprise a dedicated switching element 204, in accordance with an alternative embodiment (not illustrated) a switching element 204 can also be provided for two or more modules 201. The microelectronic modules 201 of the module array 200 are electrically connected among one another (not illustrated).

Figure 3:
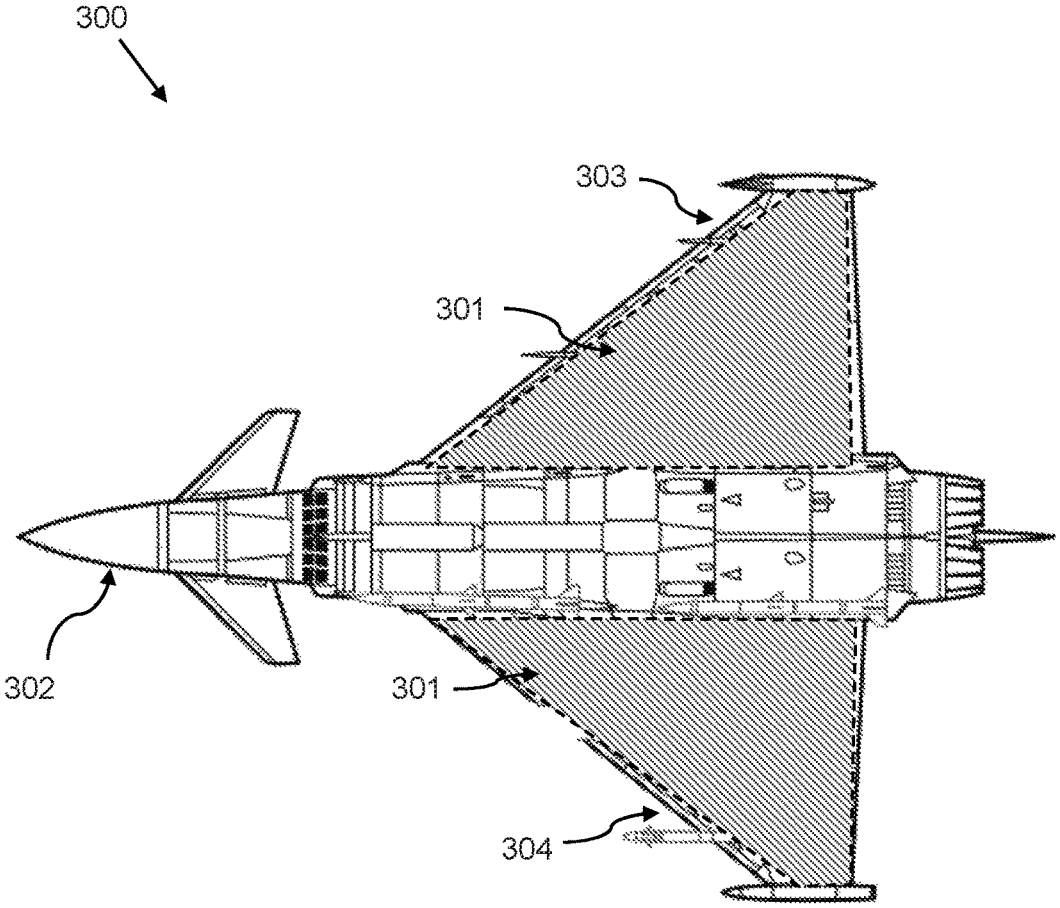
FIG. 3 shows the arrangement of a plurality of microelectronic modules on the surface of an aircraft.

FIG. 3 shows the arrangement 300 of a plurality of microelectronic modules 301 on the underside of an aircraft 302. On the underside of the airfoils 303, 304 of the vehicle 302, in the embodiment illustrated, a plurality of microelectronic modules 301 are arranged virtually over the whole area in order to alter the electromagnetic signature of the aircraft surface.

In a further embodiment (not illustrated), microelectronic modules 301 can also be provided on the entire aircraft surface, both on the underside and on the top side.

Figure 4:
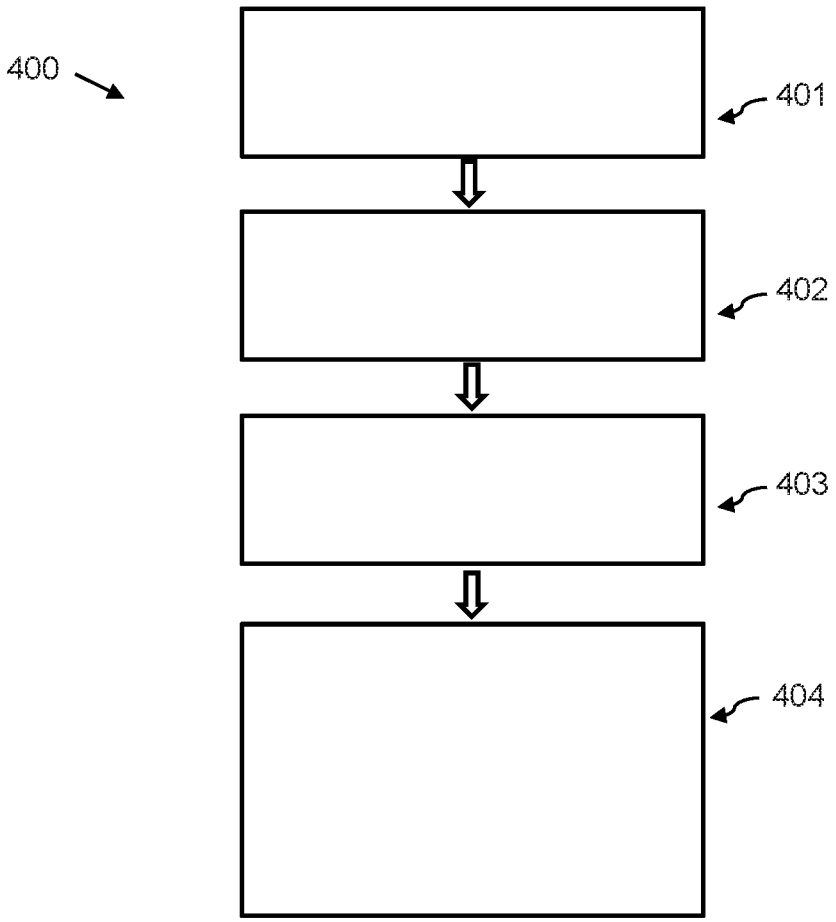
FIG. 4 shows a flow diagram of a method for altering the electromagnetic signature of a surface.

FIG. 4 shows a flow diagram 400 of a method for altering the electromagnetic signature of a surface using at least one microelectronic module or at least one module array. In step 401, a first voltage provided is converted into a higher, lower or identical second voltage. In step 402, an electromagnetic radiation is detected. In step 403, an electrical plasma is generated from the second voltage. Furthermore, in step 404, the electromagnetic signature of the surface is altered by interaction of the electrical plasma generated with an electromagnetic radiation impinging on the surface.

Although the disclosure herein has been shown and described primarily with reference to specific embodiments, it should be understood by those familiar with the technical field that numerous modifications can be made thereto with regard to configuration and details, without departing from the essence and scope of the disclosure herein, as defined by the appended claims. The scope of the disclosure herein is thus determined by the appended claims, and the intention is therefore to encompass all modifications which come under the literal sense or the range of equivalence of the claims.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a", "an" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

LIST OF REFERENCE SIGNS

100, 201, 301 module
101, 202 voltage converter
102, 203 actuator
103, 204 generator
104, 205 substrate
200 module array
300 aircraft
303, 304 airfoil
400 flow diagram
401-404 method steps
V1 first voltage
V2 second voltage

The invention claimed is:

1. A microelectronic module for altering an electromagnetic signature of a surface, comprising:

at least one voltage converter for converting a first voltage provided into a higher, lower or identical second voltage; and at least one actuator, comprising at least one generator configured for generating an electrical plasma from the second voltage provided by the voltage converter;

wherein at least the voltage converter and the actuator are arranged on a thin-layered planar substrate; and wherein the electromagnetic signature is altered by an interaction of the electrical plasma generated by the actuator with an electromagnetic radiation impinging on the surface; and wherein the at least one actuator is configured to generate the electrical plasma with a specific frequency band selected for altering the electromagnetic radiation.

2. The microelectronic module as claimed in claim 1, further comprising at least one detection unit comprising at least one sensor for detecting an electromagnetic radiation impinging on the surface; or a control unit, configured for controlling generation of the electrical plasma depending on a signal from the detection unit, a receiver for receiving external data, the external data containing information about at least one of the following: detection of the electromagnetic radiation impinging on the surface, control commands of a superordinate transmitting or control element, or information from at least one of the following: a further conventional sensor, an antenna, or a control or regulating system.

3. The microelectronic module as claimed in claim 1, wherein the actuator is configured to detect the electromagnetic radiation impinging on the surface.

4. The microelectronic module as claimed in claim 3, wherein the electrical plasma is generated depending on the detected electromagnetic radiation or the received data about the electromagnetic radiation impinging on the surface.

5. The microelectronic module as claimed in claim 1, comprising a receiver, configured for receiving data, containing information about detection of the electromagnetic radiation impinging on the surface.

6. The microelectronic module as claimed in claim 1, wherein the electromagnetic signature of the surface is altered by at least one of the following: absorbing or reflecting an outer wave of the electromagnetic radiation, by reducing backscattering of the electromagnetic radiation, or by damping a surface wave of the electromagnetic radiation, or in a combination with a radar-absorbing material (RAM) coating.

7. The microelectronic module as claimed in claim 1, wherein a frequency-selective surface is generated with aid of the at least one actuator, wherein, by driving of the at least one actuator, distributed or periodically conductive plasma structures are generatable on, in or below the surface, wherein a width of the frequency band or the center frequency are/is controllable by an applied magnetic field, wherein an active metamaterial is formed by influencing of the generated plasma, the metamaterial being usable as band-pass filter, band-stop filter, high-pass filter, low-pass filter or a combination thereof for altering the electromagnetic waves.

8. The microelectronic module as claimed in claim 1, wherein the thin-layered planar substrate is a flexible or multidimensionally deformable film or lattice.

9. The microelectronic module as claimed in claim 1, wherein the module comprises a plurality of actuators; or wherein the module comprises at least one switching element for activating or deactivating the module or at least one of the plurality of actuators; or wherein an antenna that is freely definable on the surface or an antenna array for adapting antenna gain, polarization and receiving direction can be formed by the actuators, wherein the antenna or the antenna array is usable as transmitting or receiving antenna for electromagnetic radiation; or wherein the transmitting or receiving antenna can be coupled to an external transmitter or receiver via a coupling-in or coupling-out device.

10. The microelectronic module as claimed in claim 1, wherein at least one of the voltage converter, the switching element, the actuator, the detection unit, the sensor, the receiver, the transmitter, or the control element is embodied as MEMS structure.

11. A module array, comprising a plurality of microelectronic modules as claimed in claim 1.

12. The module array as claimed in claim 11, wherein actuators of the plurality of modules are drivable in a time-staggered or phase-shifted manner;

wherein an intensity can be influenced by utilization of interference phenomena.

13. An arrangement of at least one microelectronic module or of at least one module array as claimed in claim 1 on or in a surface of a vehicle, wherein the surface has a coating that at least partly absorbs an electromagnetic radiation impinging on the surface, and wherein the vehicle is an aircraft, a watercraft or a land vehicle.

14. A method for altering the electromagnetic signature of a surface, the method comprising:

providing the surface with at least one microelectronic module or at least one microelectronic module array, wherein each of the microelectronic modules comprises:

at least one voltage converter for converting a first voltage provided into a higher, lower or identical second voltage; and at least one actuator, comprising at least one generator configured for generating an electrical plasma from the second voltage provided by the voltage converter;

wherein at least the voltage converter and the actuator are arranged on a thin-layered planar substrate; and wherein the electromagnetic signature is altered by an interaction of the electrical plasma generated by the actuator with an electromagnetic radiation impinging on the surface; and wherein the at least one actuator is configured to generate the electrical plasma with a specific frequency band selected for altering the electromagnetic radiation;

converting the first voltage provided into the higher, lower or identical second voltage;

detecting the electromagnetic radiation;

generating the electrical plasma from the second voltage; and altering the electromagnetic signature of the surface by interaction of the electrical plasma generated with the electromagnetic radiation impinging on the surface.

* * * * *